US008230946B2

(12) United States Patent
Crawford et al.

(10) Patent No.: US 8,230,946 B2
(45) Date of Patent: Jul. 31, 2012

(54) APPARATUS AND METHODS FOR SIDEWALL PERCUSSION CORING USING A VOLTAGE ACTIVATED IGNITER

(75) Inventors: Don L. Crawford, Spring, TX (US); Chi-Huang M. Chang, Sugar Land, TX (US); David L. Pozas, Bakersfield, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 360 days.

(21) Appl. No.: 12/516,406

(22) PCT Filed: Nov. 27, 2006

(86) PCT No.: PCT/US2006/061251

§ 371 (c)(1),
(2), (4) Date: Feb. 26, 2010

(87) PCT Pub. No.: WO2008/066545

PCT Pub. Date: Jun. 5, 2008

(65) Prior Publication Data

US 2010/0163305 A1 Jul. 1, 2010

(51) Int. Cl.
*E21B 49/04* (2006.01)

(52) U.S. Cl. ..... 175/4; 102/202.8

(58) Field of Classification Search ... 175/4; 102/202.5, 102/202.8

See application file for complete search history.

(56) References Cited

U.S. PATENT DOCUMENTS

| | | | |
|---|---|---|---|
| 3,978,791 | A | 9/1976 | Lemley et al. |
| 4,339,947 | A | 7/1982 | Wiley |
| 4,708,060 | A | 11/1987 | Bickes, Jr. et al. |
| 4,979,576 | A | 12/1990 | Barker et al. |
| 5,031,536 | A | 7/1991 | Barker et al. |
| 5,094,167 | A | 3/1992 | Hendley, Jr. |
| 5,460,093 | A | 10/1995 | Prinz et al. |
| 5,503,077 | A | 4/1996 | Motley |
| 6,752,083 | B1 | 6/2004 | Lerche et al. |
| 2005/0045331 | A1 | 3/2005 | Lerche et al. |
| 2005/0178282 | A1 | 8/2005 | Brooks et al. |
| 2005/0284629 | A1 | 12/2005 | Reid et al. |

FOREIGN PATENT DOCUMENTS

| | | | |
|---|---|---|---|
| EP | 0601880 | A2 | 6/1994 |
| EP | 0802092 | A1 | 10/1997 |

OTHER PUBLICATIONS

Extended European Search Report issued on Dec. 18, 2011 in European Patent Application No. 06840024.1.

PCT/US2006/061251 International Search Report and Written Opinion, Oct. 23, 2007.

PCT/US2006/061250 International Search Report and Written Opinion, Sep. 17, 2008.

*Primary Examiner* — Hoang Dang

(57) ABSTRACT

An apparatus and methods for sidewall percussion coring service are disclosed. In some embodiments, the side-wall percussion coring tool includes a voltage activated igniter, explosive material, and a core barrel in communication with the explosive material, wherein activation of the igniter causes detonation of the explosive material to propel the core barrel from tool. Some method embodiments for performing sidewall percussion coring service using the disclosed sidewall percussion coring tool include positioning the tool within a wellbore, activating the voltage activated igniter housed within the tool, detonating the explosive material within the tool with the voltage activated igniter, propelling a core barrel from the tool into the surrounding formation by detonation of the explosive material, retrieving the core barrel from the formation, and removing the tool from the wellbore.

12 Claims, 8 Drawing Sheets

APPARATUS AND METHODS FOR SIDEWALL PERCUSSION CORING USING A VOLTAGE ACTIVATED IGNITER

CROSS-REFERENCE TO RELATED APPLICATIONS

The present application claims the benefit of priority to PCT/US2006/061251 filed 27 Nov. 2006, which is incorporated herein by reference in its entirety for all purposes.

STATEMENT REGARDING FEDERALLY SPONSORED RESEARCH OR DEVELOPMENT

Not applicable.

STATEMENT REGARDING FEDERALLY SPONSORED RESEARCH OR DEVELOPMENT

Not applicable.

BACKGROUND

In a drilled well, representative samples of rock are often cored from the formation using a hollow coring bit and transported to the surface for analysis. To collect these core samples, a number of coring methods may be used, including conventional coring and sidewall coring. With conventional coring, the drillstring is first removed from the wellbore and then a rotary coring bit with a hollow interior for receiving the cut core sample is run into the well on the end of the drillstring. Sidewall coring, on the other hand, involves removing the core sample from the bore wall of the drilled well. There are generally two types of sidewall coring tools, rotary and percussion. Rotary coring is performed by forcing an open, exposed end of a hollow cylindrical coring bit against the wall of the bore hole and rotating the coring bit against the formation. Percussion coring uses cup-shaped percussion coring bits, called barrels, that are propelled against the wall of the bore hole with sufficient force to cause the barrel to forcefully enter the rock wall such that a core sample is obtained within the open end of the barrel. The barrels are then pulled from the bore wall using connections, such as cables, wires, or cords, between the coring tool and the barrel as the coring tool is moved away from the lodged coring bit. The coring tool and attached barrels are finally returned to the surface where core samples are recovered from the barrels for analysis In a typical percussion coring tool, an explosive device is used to propel the barrel from the tool into the surrounding formation. This explosive device is usually electrically fired, meaning an electrical current is used to initiate the explosion. Because these explosive devices are electrically initiated, they may be inadvertently initiated by stray voltage, static charge buildup, and radio frequency energy. In populated areas, sources of radio frequency may include CB radio, cellular telephones, radar, microwaves used for special communication and heat generation, conventional radio signals, power lines, high power amplifiers, high frequency electrical transformers, coaxial cables, etc. With respect to locations offshore, another source of radio frequency is powerful land-based transmitters used to communicate with equipment located on offshore platforms. Given the vast number of stray radio frequency sources, shutting these sources down temporarily so that sidewall percussion coring may be performed is impractical, if not impossible, particularly in congested areas near land-based oil and gas fields.

BRIEF DESCRIPTION OF THE DRAWINGS

For a more detailed description of the present invention, reference will now be made to the accompanying drawings, wherein.

DETAILED DESCRIPTION

Figure 1:
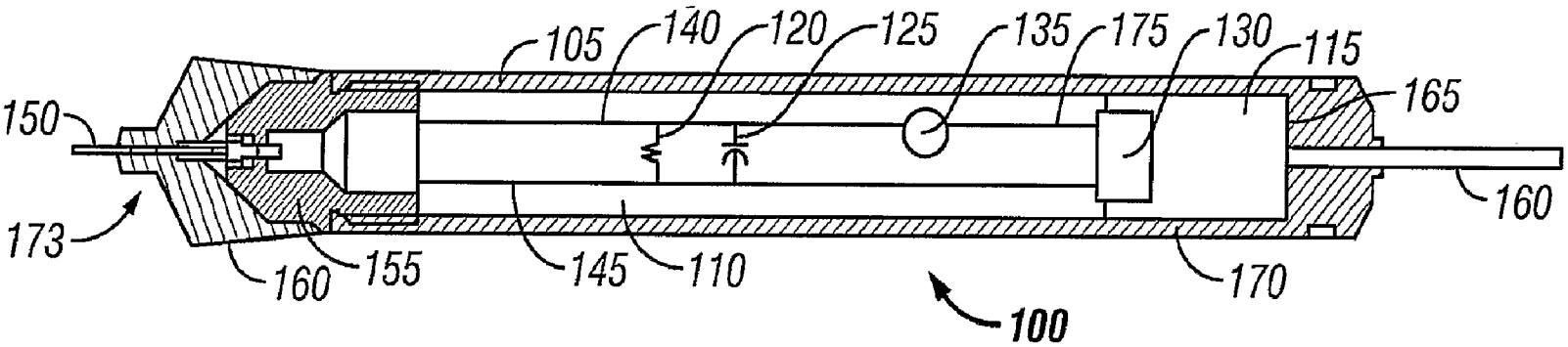
FIG. 1 is cross-sectional view of one embodiment of a voltage activated igniter.

Various embodiments of a sidewall percussion coring tool comprising a voltage activated igniter and its method of use will now be described with reference to the accompanying drawings. In the drawings and description that follow, like parts are marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness.

Embodiments of the sidewall percussion coring tool and methods disclosed herein may be used in any type of application, operation, or process where it is desired to perform sidewall percussion coring service. Moreover, the tool and its methods of use are susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements unless specifically noted and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 illustrates a cross-sectional view of a representative voltage activated igniter 100 comprising a housing 105 having a bore 110 therethrough, an explosive charge 115, a bleeder resistor 120, a capacitor 125, a semiconductor bridge (SCB) 130, and a spark gap 135 for protecting the igniter 100 against accidental initiation. The SCB 130 and the spark gap 135 are connected by a pair of electrically conductive wires 140, 145 to a means (not shown) for introducing an electrical charge into the SCB 130 The electrical charge is introduced to the SCB 130 by applying positive DC voltage across the leads 150 using any suitable means in the art, such as but not limited to, electrical wiring run downhole from the surface or a battery. The housing 105 at one end is sealed with a seal cap 155 and, surrounding that, a pressure seal boot 160. In other embodiments, the seal cap 155 may be replaced with a radio frequency attenuator 163. At the opposite end of the igniter 100, a venting tube 160 is inserted into and extends from the explosive charge 115. An end seal cap 165 acts as a barrier between the explosive charge 115 and the surrounding environment.

The housing 105 of the voltage activated igniter 100 includes a bore 110 therethrough, the diameter being sufficient to permit inclusion of an SCB 130 within the bore 110. The thickness of the housing wall varies, typically ranging from 0.075" to 0.125 inches thick. The housing 105 is comprised of substantially any material of high impedance, such as, for example, aluminum, steel, stainless steel, brass, and rigid plastics. Regardless of the housing 105 material, it must be suitable for high temperature applications, i e., temperatures up to 400 degrees Fahrenheit or above.

The explosive charge 115 may be introduced into the housing 105 as a powder and thereafter compressed by application of, for example, a ram to the explosive 115 at the end 170 of the housing 105. The explosive charge 115 comprises any suitable explosive material known in the art, such as but not limited to, granular cyclotetramethylene tetranitramine (HMX), hexanitrostilbene (HNS), bis(picrylamino) trinitropyridine (PYX), trinitrotrimethylenetriamine (RDX) and mixtures thereof. The end 170 of the housing 10 is sealed by a thin metal or plastic disk that is pressed into place or by a thin layer of epoxy to provide a seal 165 on the exposed end of the explosive 115 in the bore 110 of igniter 100.

The SCB 130 is positioned within the housing 105 such that it will be in contact with or at least close proximity to the explosive charge 115. Preferably, the SCB 130 is positioned such that it will be in contact with the surface of the explosive charge 115 exposed in the bore 110. The SCB 130 may be any suitable, commercially available semiconductor bridge in a size capable of insertion within the housing 105. Suitable SCBs are available from, for example, Thiokol Corporation, Elkton, Md. and SCB Technologies, Inc., Albuquerque, N. Mex. The SCB 130 may be activated by any suitable electrical charge, including but not limited to, an electrical charge of approximately 173 volts at an amperage of approximately 0.010 amps. It is to be understood, however, that other SCBs suitable for initiating the deflagration reaction with the explosive charge 115 in the igniter 100 may be used.

The SCB 130 is connected by an electrically conductive wire 175 to a spark gap 135. The spark gap 135 protects the igniter 100 against accidental initiation by an electrostatic discharge, stray voltage, radio frequency energy, or other unintended sources of electrical current. The spark gap 135 has a voltage threshold, for example, 150 to 158 volts, before passage of an electrical charge to the SCB 130 occurs. This prevents accidental initiation by unintended electrical charges below the threshold. Spark gaps 135 are available with various ratings, and igniters 100 may be prepared using different spark gaps 135 to permit controlled initiation of individual or multiple explosive charges in response to different electrical charges transmitted from an electrical source. Suitable spark gaps 135 are available from, for example, Reynolds Industries, Okyia, and Lumex Opto.

The SCB 130 and spark gap 135 are provided with electrically conductive wires 140, 145 that provide an electrical connection that extends outside the housing 105. At the connection end 173 of the igniter 100, the housing 105 may be sealed with plastic resins or similar materials 155 that bond to the housing 105 to seal the various components within the housing 105. The electrically conductive wires 140, 145 pass through the seal cap 155, leaving the leads 150 exposed for application of an electrical charge. Alternatively, the housing 105 may be sealed by insertion of a radio frequency attenuator 163, in lieu of the seal cap 155, having passageways therethrough to allow the wires 140, 145 to extend from the housing 105. A radio frequency attenuator 163 may reduce the strength of any radio signal present to a level whereby the signal is incapable of accidental initiation of the igniter 100. Suitable radio frequency attenuators 163 include the MN 68 ferrite device available from Attenuation Technologies, La Plata, Md.

Figure 2:
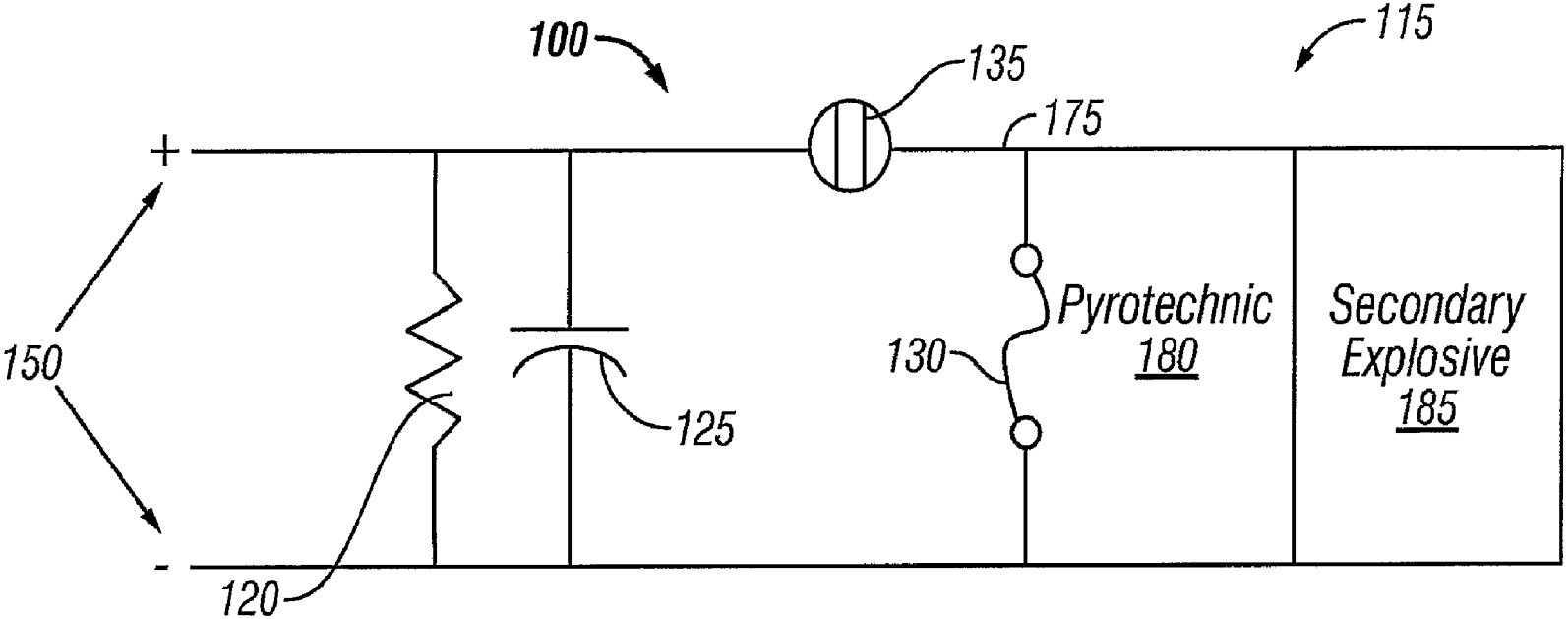
FIG. 2 is a schematic illustration of the electrical circuit for the voltage activated igniter depicted in FIG. 1.

FIG. 2 depicts an electrical circuit for the voltage activated igniter 100 comprising the spark gap 135 connected to the SCB 130 by the electrically conductive wire 175, the capacitor 125, the bleeder resistor 120, and the explosive charge 115. The explosive charge 115 includes a pyrotechnic 180 and a secondary explosive 185 in contact with the SCB 130 The capacitor 125 is utilized to store electrical energy sufficient to pass through the spark gap 135 and initiate the SCB 130. The bleeder resistor 120 is used to slowly drain the capacitor 125 in the event the capacitor 125 is partially charged during an interrupted firing of the igniter 100 Typically, the capacitor 125 is selected to provide a capacitance of 3.5 mF, while the bleeder resistor 120 provides a 10,000 to 20,000 ohm resistance. Although FIG. 2 illustrates a single capacitor 125 and a single resistor 120, one skilled in the art may readily appreciate that multiple capacitors of varied capacitances and/or multiple resistors of varied resistances may be employed to perform these same functions. Moreover, FIGS. 1 and 2 depict illustrations for only one embodiment of a voltage activated igniter. One skilled in the art may readily appreciate that various other combinations of the disclosed components, e.g. explosive materials, SCBs, and spark gaps, may be utilized to produce the same result, namely a voltage activated igniter that is immune to stray voltage, static discharge buildup, and radio frequency energy.

Figure 3:
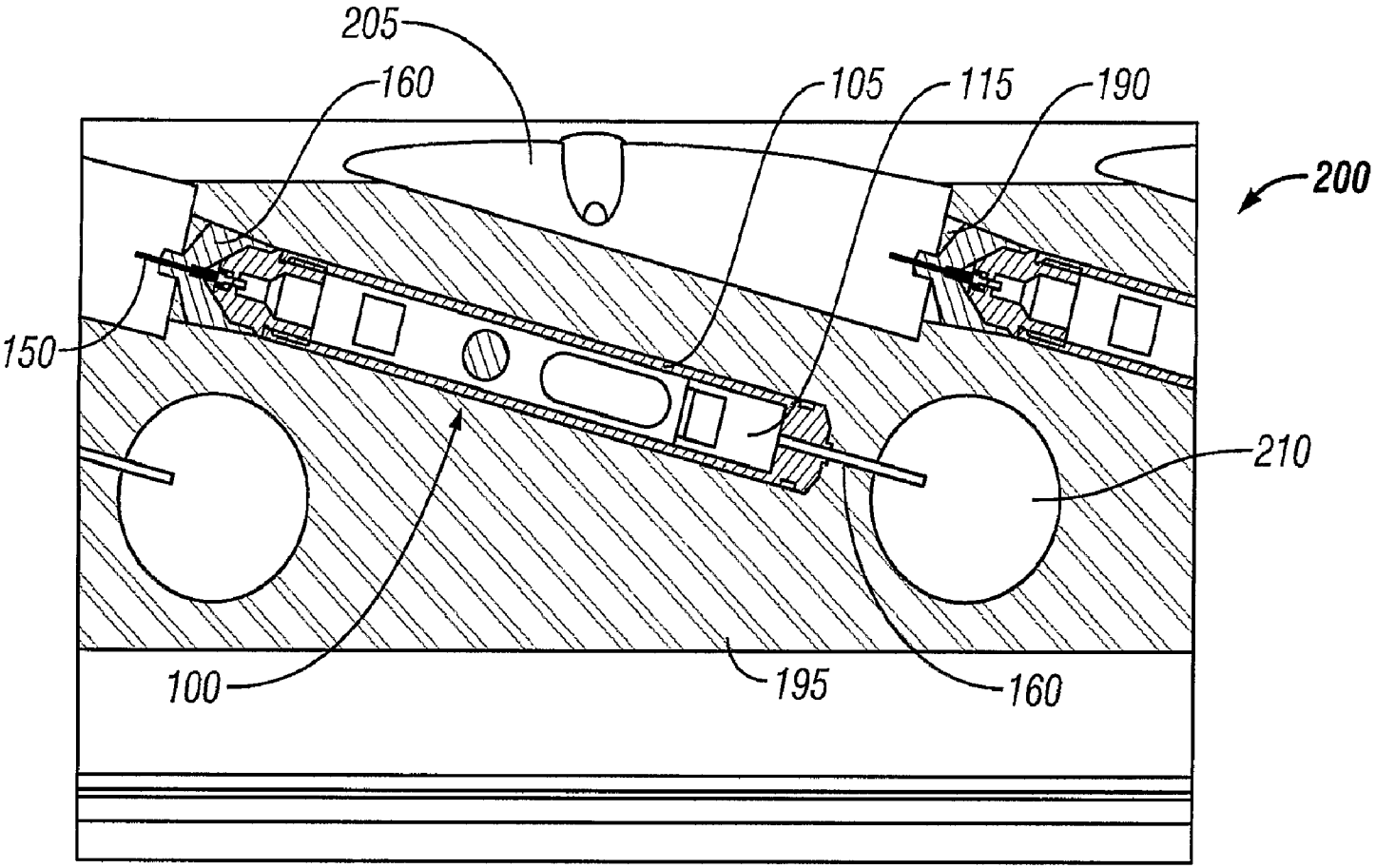
FIG. 3 is a cross-sectional view of one embodiment of a core gun comprising a voltage activated igniter.
Figure 4:
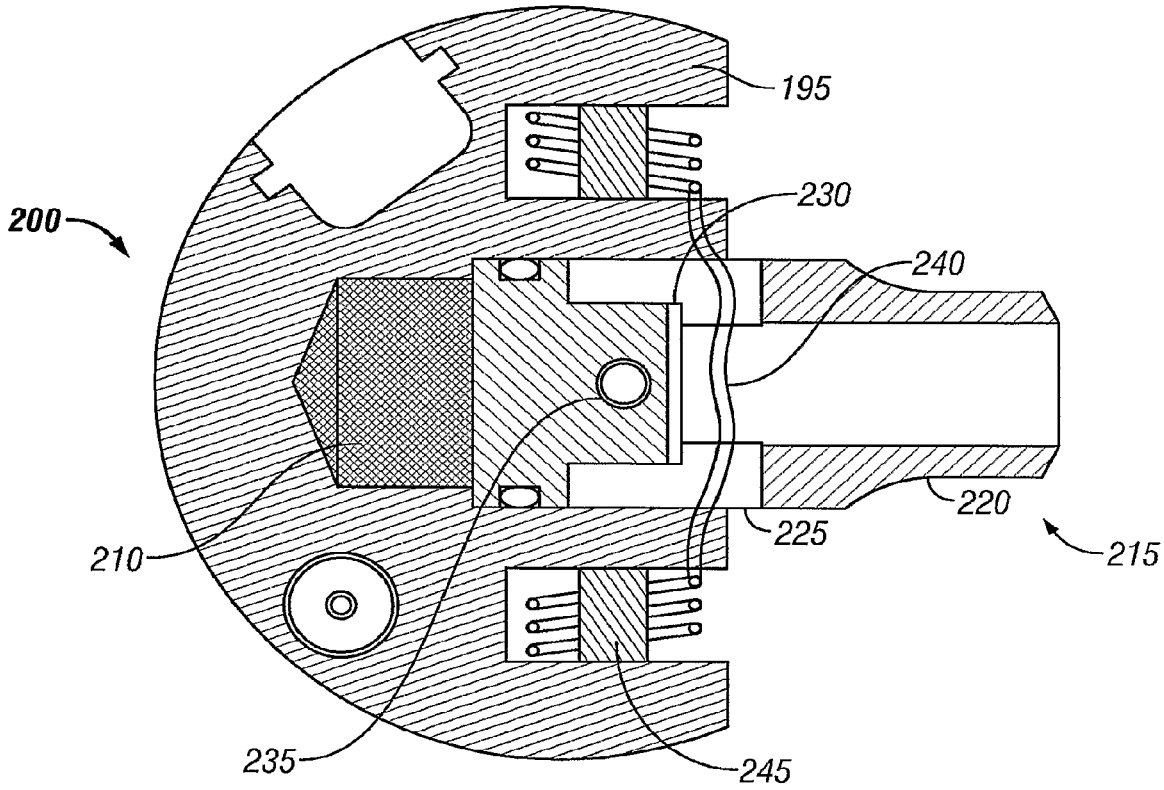
FIG. 4 is an end view of the core gun depicted in FIG. 3.

FIGS. 3 and 4 depict cross-sectional and end views, respectively, of a sidewall percussion coring tool 200 that utilizes at least one voltage activated igniter 100 to propel at least one barrel 215 into the surrounding formation. In some embodiments, including those depicted by FIGS. 3 and 4, the sidewall percussion coring tool 200 is a core gun. The tool 200 utilizes one or more voltage activated igniters 100 to ignite one or more quantities of core load explosive 210. Once ignited, the core load explosive 210 detonates, propelling the core barrel 215 into the surrounding formation. The at least one voltage activated igniter 100 is positioned inside cavity 190 within the tool body 195. Leads 150 extend from the outer end of the igniter 100 and may be attached to electrical wiring (not shown) used to apply an electrical charge to the igniter 100. The connector end 173 of the igniter 100, including the leads 150 and any attached electrical wiring, is sealed by an outer seal 205.

The core barrel 215, which will be propelled into the surrounding formation to collect a core sample, is seated on the core explosive load 210 The core barrel 215 includes the barrel shaft 220 through which a slot 225 passes, a seal plug 230, and a seal plug retainer pin 235. A core barrel retainer cable 240 passes through slot 225 of the barrel shaft 220. Each end of the core barrel retainer cable 240 is wrapped multiple times around and attached to a cable retainer pin 245, which is securely fastened to the tool body 195. The seal plug 230 provides a means of sealing the cable 240 within slot 225 at the base of the barrel shaft 220, while the seal plug retainer pin 235 locks the seal plug 230 to the barrel shaft 220. When the core load explosive 210 detonates, the core barrel 215 is propelled into the formation while remaining tethered to the tool body 195 by the core barrel retainer cable 240 and the cable retainer pins 245.

Figure 5A:
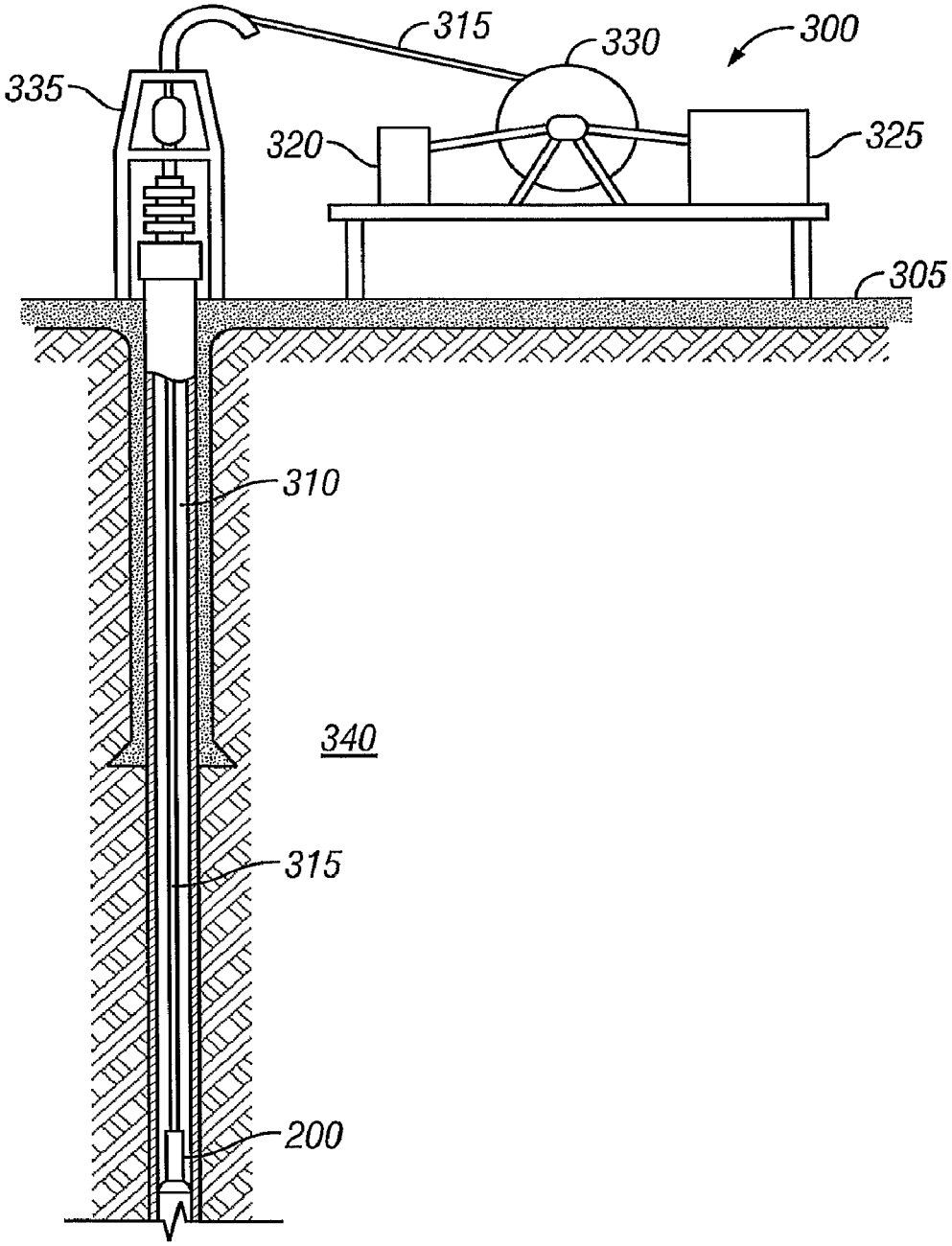
FIGS. 5A to 5D depict a typical sequence for removing a core sample using a sidewall percussion coring tool comprising the voltage activated igniter depicted in FIG. 1.

FIGS. 5A through 5D schematically depict one embodiment of a sequence of operations wherein the sidewall percussion coring tool 200, comprising multiple voltage activated igniters 100, is used to collect core samples. FIG. 5A depicts one representative sidewall percussion coring service environment comprising a coiled tubing system 300 on the surface 305 and one embodiment of a sidewall percussion coring tool 200 being lowered into a wellbore 310 on coiled tubing 315. The coiled tubing system 300 includes a power supply 320, a surface processor 325, and a coiled tubing spool 330. An injector head unit 335 feeds and directs the coiled tubing 315 from the spool 330 into the wellbore 310. Although this figure depicts the use of coiled tubing 315 to lower the sidewall percussion coring tool 200 within the wellbore 310, one skilled in the art may readily appreciate that any similar means, for example, wireline, may be used.

Figure 5B:
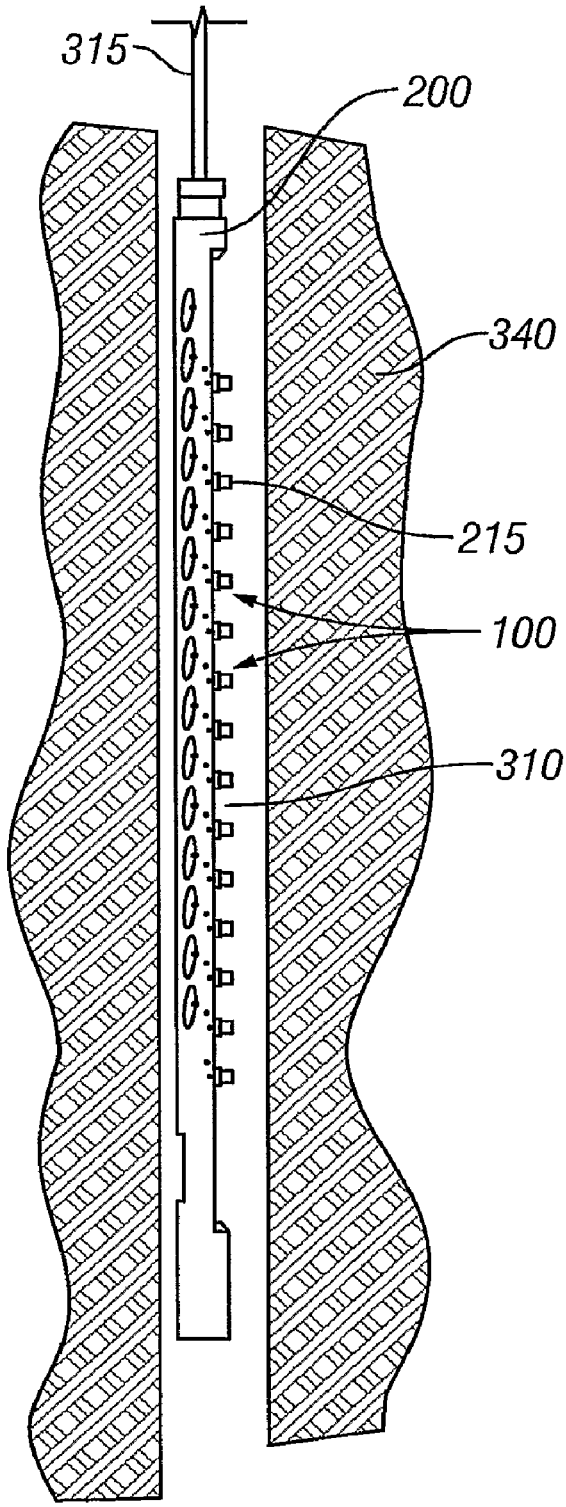

FIG. 5B depicts the sidewall percussion coring tool 200, shown in FIG. 5A, at the desired position in the wellbore 310 after run-in is complete. In this position, the igniters 100 are activated to propel the core barrels 215 into the surrounding formation 340, wherein each igniter 100 ignites the explosive charge 115 contained within it and subsequently detonates the core load explosive 210 in contact with it via a venting tube 160 to propel a single core barrel 215.

Figure 5C:
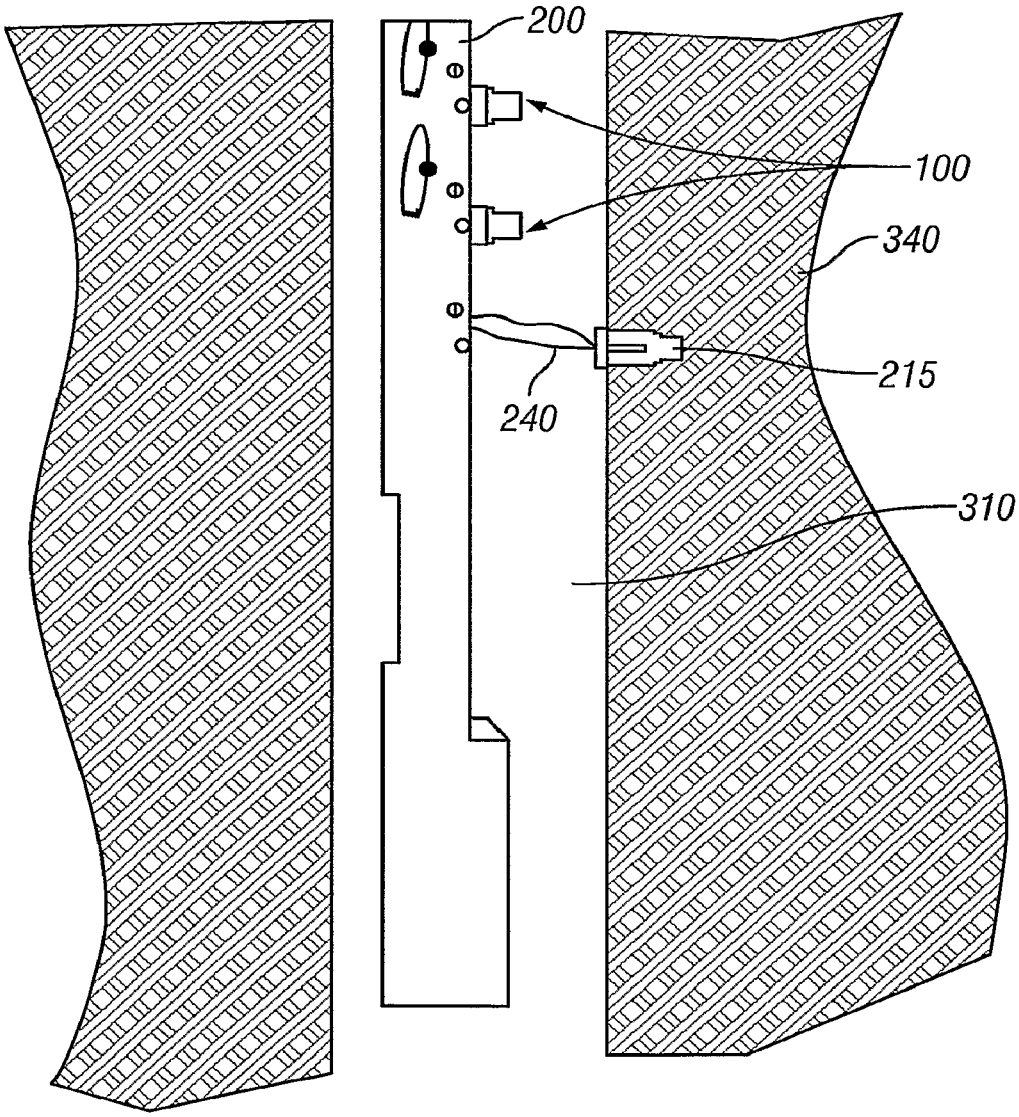

Firing of each igniter 100 is accomplished by applying positive DC voltage across its leads 150. In some embodiments, the DC voltage source may be electrical wiring run from the surface 305 into the wellbore 310 along with and attached to the tool 200. In other embodiments, the DC voltage source may be a battery(s) attached to or housed within the tool 200. As the positive DC voltage is applied to the leads 150, the capacitor 125 charges until a threshold level is reached, for example, between 130 and 160 volts, at which point the fixed voltage gap breaks down. Upon gap discharge, current flows through the SCB 130, causing it to vaporize. Vaporization of the SCB 130 generates plasma gases that ignite the pyrotechnic 180. The burning pyrotechnic 180, in turn, causes a deflagration reaction to begin in the secondary explosive 185. Hot gases resulting from burning of the pyrotechnic 180 and the secondary explosive 185 of the explosive charge 115 pass through the venting tube 160 to ignite and subsequently detonate the core load explosive 210. Upon detonation of the core load explosive 210, the core barrel 215 is propelled into the formation 340. As shown in FIG. 5C, a single core barrel 215 is depicted as having been propelled into the formation 340. One skilled in the art may readily appreciate that a single, multiple, or all core barrels 215 housed within the sidewall percussion coring tool 200 may be deployed into the formation 340 in the same fashion.

Figure 5D:
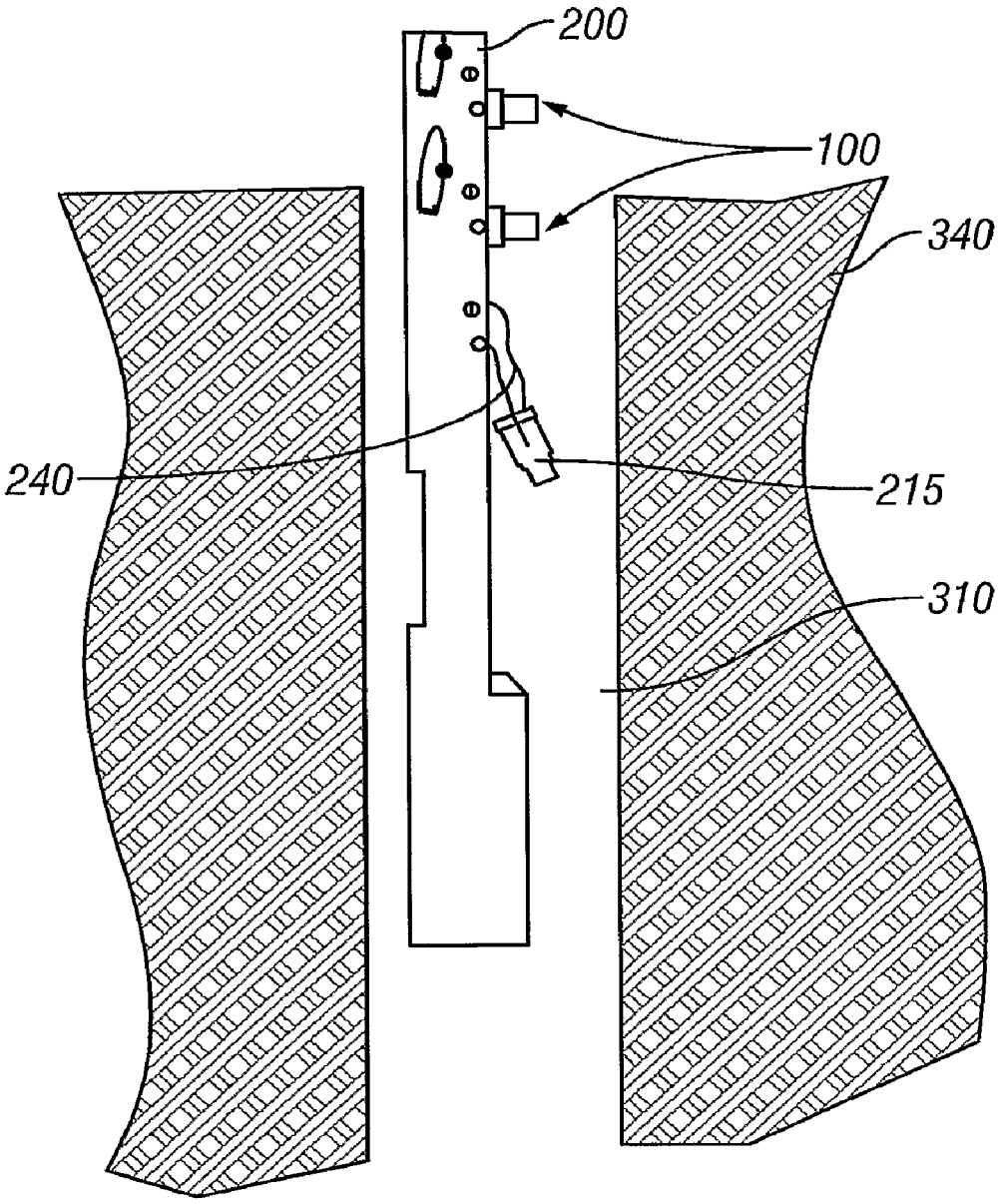

As depicted in FIG. 5D, the sidewall percussion coring tool 200 and attached core barrels 215 may be removed from the wellbore 310 by retracting the coiled tubing 315. As the coiled tubing 315 is retracted and the tool 200 is pulled towards the surface 305, the core barrel retainer cable 240 remains securely fastened both to the core barrel 215 and the tool 200, thereby pulling the core barrel 215 from the formation 340 wall. Once extracted from the formation 340, each core barrel 215 contains a core sample of the formation 340, which may retrieved from the core barrel 215 for analysis after the tool 200 reaches the surface 305.

While various embodiments of and methods of using a sidewall percussion coring tool comprising at least one voltage activated igniter have been shown and described herein, modifications may be made by one skilled in the art without departing from the spirit and the teachings of the invention. The embodiments described are representative only, and are not intended to be limiting. Many variations, combinations, and modifications of the applications disclosed herein are possible and are within the scope of the invention. Accordingly, the scope of protection is not limited by the description set out above, but is defined by the claims which follow, that scope including all equivalents of the subject matter of the claims.

What is claimed is:

1. A sidewall percussion coring tool including:
- a tool housing;
- an explosive material disposed within the tool housing;
- a voltage activated igniter comprising:
  - an igniter housing that defines an internal volume;
  - a semiconductor bridge disposed within the internal volume;
  - a spark gap disposed within the internal volume and electrically coupled in series to the semiconductor bridge;
  - a capacitor disposed within the internal volume and electrically coupled in parallel with the spark gap and semiconductor bridge;
  - a resistor disposed within the internal volume and electrically coupled in parallel with the capacitor;
  - a pyrotechnic that abuts the semiconductor bridge, the pyrotechnic disposed within the internal volume;
  - an explosive charge that abuts the pyrotechnic, the explosive charge disposed within the internal volume; and
  - a vent tube distinct from the igniter housing, the vent tube fluidly coupling the internal volume to the explosive charge into the explosive material; and
- a core barrel, the core barrel being propellable out of the housing by the detonation of the explosive material.

2. The tool of claim 1, wherein the core barrel is attached to the sidewall percussion coring tool by a tether, wire, or cable.

3. The sidewall percussion coring tool of claim 1 wherein the voltage activated igniter further comprises a pressure seal disposed on a first end of the igniter housing opposite the vent tube.

4. A method of performing sidewall percussion coring service including:
- positioning a sidewall percussion coring tool within a wellbore;
- applying a voltage to a voltage activated igniter housed within the sidewall percussion coring tool;
- activating the voltage activated igniter when the voltage rises above a threshold voltage, the activating by:
  - conducting current across a spark gap disposed within the voltage activated igniter;
  - vaporizing a semiconductor bridge by the current, the semiconductor bridge within the voltage activated igniter;
  - igniting a pyrotechnic by the semiconductor bridge, the pyrotechnic disposed within the voltage activated igniter;
  - causing deflagration of a first explosive by the pyrotechnic, the explosive within the voltage activated igniter;
  - conducing hot gasses to a second explosive material by way of a tube;
- detonating a second explosive material within the sidewall percussion coring tool by the hot gasses conducted through the tube of the voltage activated igniter;
- propelling a core barrel from the sidewall percussion coring tool into the surrounding formation by detonation of the explosive material;
- retrieving the core barrel from the formation; and
- removing the sidewall percussion coring tool from the wellbore.

5. The method of claim 4, wherein the positioning is accomplished using coiled tubing or wireline.

6. The method of claim 4, wherein the voltage is a positive DC voltage applied using electrical wiring run into the wellbore from the surface or a battery housed within the sidewall percussion coring tool.

7. The method of claim 5, wherein retrieving the core barrel and removing the sidewall percussion coring tool include retracting the coiled tubing or the wireline from the wellbore.

8. The method of claim 4, wherein removing the sidewall percussion coring tool causes the retrieving the core barrel by means of a tether, cable or wire attached at one end to the core barrel and at the other end to the sidewall percussion coring tool.

9. The method of claim 4, further including activating more than one voltage activated igniter in series.

10. The method of claim 4, further including propelling more than one core barrel from the sidewall percussion coring tool.

11. The method of claim 4, further including extracting a core sample from the core barrel at the surface.

12. The method of claim 4, wherein the sidewall percussion coring tool is a core gun.

* * * * *

UNITED STATES PATENT AND TRADEMARK OFFICE

CERTIFICATE OF CORRECTION

PATENT NO. : 8,230,946 B2
APPLICATION NO. : 12/516406
DATED : July 31, 2012
INVENTOR(S) : Don L. Crawford, Chi-Huang M. Chang and David L. Pozas It is certified that error appears in the above-identified patent and that said Letters Patent is hereby corrected as shown below:

Column 6, Claim 4, line 57, the word "conducing" should read "conducting".

Signed and Sealed this
Twenty-sixth Day of February, 2013

Teresa Stanek Rea
*Acting Director of the United States Patent and Trademark Office*